US008886523B2

(12) United States Patent
Virette et al.

(10) Patent No.: US 8,886,523 B2
(45) Date of Patent: Nov. 11, 2014

(54) AUDIO DECODING BASED ON AUDIO CLASS WITH CONTROL CODE FOR POST-PROCESSING MODES

(75) Inventors: David Sylvain Thierry Virette, Munich (DE); Yang Gao, Mission Viejo, CA (US); Wei Xiao, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 672 days.

(21) Appl. No.: 12/893,526

(22) Filed: Sep. 29, 2010

(65) Prior Publication Data

US 2011/0257984 A1 Oct. 20, 2011

Related U.S. Application Data

(60) Provisional application No. 61/323,878, filed on Apr. 14, 2010.

(51) Int. Cl.

| | |
|---|---|
| ***G10L 19/02*** | (2013.01) |
| ***G10L 21/02*** | (2013.01) |
| ***G10L 19/26*** | (2013.01) |
| *G10L 25/18* | (2013.01) |

(52) U.S. Cl.
CPC *G10L 19/26* (2013.01); *G10L 25/18* (2013.01)
USPC ..... 704/205; 704/206; 704/501

(58) Field of Classification Search
CPC ..... G10L 19/02; G10L 19/22; G10L 19/26; G10L 21/02; G10L 21/0232; G10L 25/18
USPC ..... 704/205, 206, 500, 501
See application file for complete search history.

(56) References Cited

U.S. PATENT DOCUMENTS

| | | | | |
|---|---|---|---|---|
| 5,481,614 | A * | 1/1996 | Johnston | 704/200.1 |
| 6,138,093 | A * | 10/2000 | Ekudden et al. | 704/228 |
| 6,785,645 | B2 * | 8/2004 | Khalil et al. | 704/216 |
| 7,457,747 | B2 * | 11/2008 | Ojanpera | 704/226 |
| 7,848,921 | B2 * | 12/2010 | Ehara | 704/216 |
| 8,060,362 | B2 * | 11/2011 | Ojanpera | 704/226 |
| 8,095,360 | B2 * | 1/2012 | Gao | 704/205 |
| 8,175,145 | B2 * | 5/2012 | Garcia et al. | 375/240 |
| 8,401,845 | B2 * | 3/2013 | Vaillancourt et al. | 704/228 |
| 8,571,852 | B2 * | 10/2013 | Bruhn | 704/201 |
| 8,577,673 | B2 * | 11/2013 | Gao | 704/207 |
| 2004/0008615 | A1 * | 1/2004 | Oh | 370/203 |
| 2005/0165603 | A1 * | 7/2005 | Bessette et al. | 704/200.1 |
| 2009/0222261 | A1 * | 9/2009 | Jung et al. | 704/219 |

(Continued)

OTHER PUBLICATIONS

Fuchs and Lefebvre, "A New Post-Filtering for Artificially Replicated High-Band in Speech Coders", ICASSP 2006. 2006 Conference on Acoustics, Speech and Signal Processing, 2006, May 14-19, 2006, vol. 1, pp. I-713 to I-716.*

(Continued)

*Primary Examiner* — Martin Lerner
(74) *Attorney, Agent, or Firm* — Slater & Matsil, L.L.P.

(57) ABSTRACT

In accordance with an embodiment, a method of generating an encoded audio signal, the method includes estimating a time-frequency energy of an input audio signal from a time-frequency filter bank, computing a global variance of the time-frequency energy, determining a post-processing method according to the global variance, and transmitting an encoded representation of the input audio signal along with an indication of the determined post-processing method.

40 Claims, 10 Drawing Sheets

(56) References Cited

U.S. PATENT DOCUMENTS

| | | | | |
|---|---|---|---|---|
| 2009/0287478 | A1* | 11/2009 | Gao | 704/204 |
| 2009/0306992 | A1* | 12/2009 | Ragot et al. | 704/500 |
| 2010/0063802 | A1* | 3/2010 | Gao | 704/201 |
| 2010/0070270 | A1* | 3/2010 | Gao | 704/207 |
| 2010/0070285 | A1* | 3/2010 | Kim et al. | 704/500 |
| 2010/0286991 | A1* | 11/2010 | Hedelin et al. | 704/500 |
| 2011/0054911 | A1* | 3/2011 | Baumgarte et al. | 704/500 |
| 2011/0257979 | A1* | 10/2011 | Gao | 704/500 |

OTHER PUBLICATIONS

Xiao, W., et al., "CE on adaptive T/F domain post-processing for USAC," ISO/IEC JTC1/SC29/WG11 Coding of Moving Pictures and Audio, Apr. 2010, pp. 1-6, MPEG2010/M17575, Dresden, Germany.

"Discussion and Link Level Simulation Results on LTE-A Downlink Multi-site MIMO Cooperation," 3GPP TSG-RAN Working Group 1 Meeting #55, Nov. 10-14, 2008, pp. 1-11, R1-084465, Nortel, Prague, Czech Republic.

"Analysis of CQI/PMI Feedback for Downlink CoMP," 3GPP TSG RAN WG1 meeting #56, Feb. 9-13, 2009, 4 pages, R1-090941, CATT, Athens, Greece.

ISO/IEC JTC1/SC29/WG11, MPEG2010/N11299, 2009, 9 pages, ISO/IEC.

"TP for feedback in support of DL CoMP for LTE-A TR," 3GPP TSG-RAN WG1 #57, May 4-8, 2009, pp. 1-4, R1-092290, Agenda Item 15.2, Qualcomm Europe, San Fransisco, CA.

Chen, J-H., et al., "Adaptive Postfiltering for Quality Enhancement of Coded Speech," IEEE Transactions on Speech and Audio Processing, Jan. 1995, vol. 3, No. 1.

Ekstrand, P., "Bandwidth Extension of Audio Signals by Spectral Band Replications," Proc. 1st IEEE Benelux Workshop on Model based Processing and Coding of Audio (MPCA-2002), Nov. 15, 2002, Leuven, Belgium.

Dietz, M., "Spectral Band Replication, a novel approach in audio coding," Audio Engineering Society, Convention Paper 5553, May 10-13, 2002, 112th Convention, Munich Germany.

"WD7 of USAC," ISO/IEC JTC1/SC29/WG11, N11299, Apr. 2010, Dresden, Germany.

"WD6 of USAC," ISO/IEC JTC1/SC29/WG11, N11213, Jan. 2010, Kyoto, Japan.

* cited by examiner

AUDIO DECODING BASED ON AUDIO CLASS WITH CONTROL CODE FOR POST-PROCESSING MODES

This application claims the benefit of U.S. Provisional Application No. 61/323,878 filed on Apr. 14, 2010, entitled "Noise-Like Signal Detection and Signaling for Post-processing Control" which application is hereby incorporated herein by reference.

TECHNICAL FIELD

The present invention relates generally to audio and image processing, and more particularly to a system and method for audio coding and decoding.

BACKGROUND

In modern audio/speech digital signal communication systems, a digital signal is compressed at an encoder, and the compressed information (bitstream) is then packetized and sent to a decoder through a communication channel frame by frame. The system of encoder and decoder together is called CODEC. Speech and audio compression may be used to reduce the number of bits that represent the speech and audio signal, thereby reducing the bandwidth and/or bit rate needed for transmission. However, speech and audio compression may result in quality degradation of the decompressed signal. In general, a higher bit rate results in a higher quality decoded signal, while a lower bit rate results in lower quality decoded signal.

Audio coding based on filter bank technology is widely used. In this type of signal processing, the filter bank is an array of band-pass filters that separates the input signal into multiple components, where each band-pass filter carries a single frequency subband of the original signal. The process of decomposition performed by the filter bank is called analysis, and the output of filter bank analysis is referred to as a subband signal with as many subbands as there are filters in the filter bank. The reconstruction process is called filter bank synthesis. In digital signal processing, the term filter bank is also commonly applied to a bank of receivers. In some systems, receivers also down-convert the subbands to a low center frequency that can be re-sampled at a reduced rate. The same result can sometimes be achieved by undersampling the bandpass subbands. The output of filter bank analysis could be in a form of complex coefficients, where each complex coefficient contains a real element and an imaginary element respectively representing cosine term and sine term for each subband of filter bank.

In the application of filter banks for signal compression, some frequencies are perceptually more important than others from a psychoacoustic perspective. After decomposition, the important frequencies can be coded with a fine resolution. In some cases, coding schemes that preserve this fine resolution are used to maintain signal quality. On the other hand, less important frequencies can be coded with a coarser coding scheme, even though some of the finer details will be lost in the coding. A typical coarser coding scheme is based on a concept of BandWidth Extension (BWE). This technology is also referred to as High Band Extension (HBE), SubBand Replica (SBR) or Spectral Band Replication (SBR). These coding schemes encode and decode some frequency subbands (usually high bands) with a small bit rate budget (even a zero bit rate budget) or significantly lower bit rate than a normal encoding/decoding approach. With SBR technology, the spectral fine structure in the high frequency band is copied from low frequency band and some random noise is added. The spectral envelope in high frequency band is then shaped by using side information transmitted from encoder to decoder.

In some applications, post-processing at the decoder side is used to improve the perceptual quality of signals coded by low bit rate and SBR coding.

SUMMARY OF THE INVENTION

In accordance with an embodiment, a method of generating an encoded audio signal, the method includes estimating a time-frequency energy of an input audio signal from a time-frequency filter bank, computing a global variance of the time-frequency energy, determining a post-processing method according to the global variance, and transmitting an encoded representation of the input audio signal along with an indication of the determined post-processing method.

In accordance with a further embodiment, a method for generating an encoded audio signal includes receiving a frame comprising a time-frequency (T/F) representation of an input audio signal, the T/F representation having time slots, where each time slot has subbands. The method also includes estimating energy in subbands of the time slots, estimating a time variance across a first plurality of time slots for each of a second plurality of subbands, estimating a frequency variance of the time variance across the second plurality of subbands, determining a class of audio signal by comparing the frequency variance with a threshold, and transmitting the encoded audio signal, where the encoded audio signal comprises a coded representation of the input audio signal and a control code based on the class of audio signal.

In accordance with a further embodiment, a method of receiving an encoded audio signal, the method includes receiving an encoded audio signal comprising a coded representation of an input audio signal and a control code based on an audio signal class. The method further includes decoding the audio signal, post-processing the decoded audio signal in a first mode if the control code indicates that the audio signal class is not of a first audio class, and post-processing the decoded audio signal in a second mode if the control code indicates that the audio signal class is of the first audio class. The method further includes producing an output audio signal based on the post-processed decoded audio signal.

In accordance with a further embodiment, a system for generating an encoded audio signal, the system includes a low-band signal parameter encoder for encoding a low-band portion of an input audio signal and a high-band time-frequency analysis filter bank producing high-band side parameters from the input audio signal. The system also includes a noise-like signal detector coupled to an output of the high-band time-frequency analysis filter bank, where the noise-like signal detector configured to estimate time-frequency energy of the high-band side parameters, compute a global variance of the time-frequency energy, and determine a post-processing method according to the global variance.

In accordance with a further embodiment, a device for receiving an encoded audio signal includes a receiver for receiving the encoded audio signal and for receiving control information, where the control information indicates whether the encoded audio signal has noise-like properties. The device further includes an audio decoder for producing coefficients from the encoded audio signal, a post-processor for post-processing the coefficients in a filter bank domain according to the control information to produce a post-processed signal, and a synthesis filter bank for producing an output audio signal from the post-processed signal.

In accordance with a further embodiment, a non-transitory computer readable medium has an executable program stored thereon, where the program instructs a microprocessor to decode an encoded audio signal to produce a decoded audio signal, where the encoded audio signal includes a coded representation of an input audio signal and a control code based on an audio signal class. The program also instructs the microprocessor to post-process the decoded audio signal in a first mode if the control code indicates that the audio signal class is not noise-like, and post-process the decoded audio signal in a second mode if the control code indicates that the audio signal class is noise-like.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for audio coding and decoding. Embodiments of the invention may also be applied to other types of signal processing such as those used in medical devices, for example, in the transmission of electrocardiograms or other type of medical signals.

Figure 1:
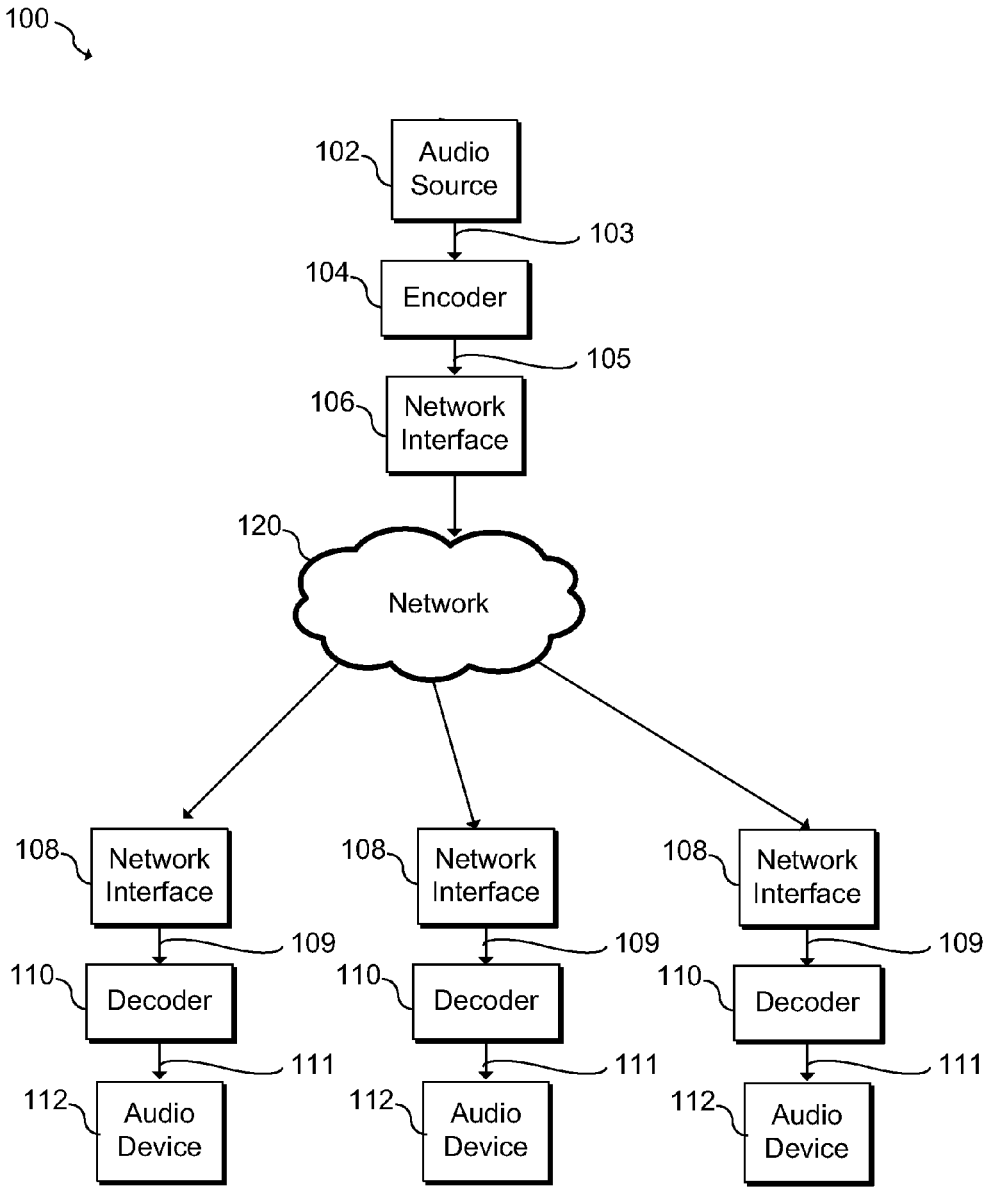
FIG. 1 illustrates an embodiment audio transmission system.

FIG. 1 illustrates an example system 100 according to an embodiment of the present invention. Encoder 104, which operates according to embodiments of the present invention, encodes audio signal 103 from the output of audio source 102 and transmits encoded audio signal 105 to network interface 106. Audio source 102 can be an analog audio source such as a microphone or audio transducer, or a digital audio source such as a digital audio file stored in memory or on a digital audio media such as a compact disk or flash drive. Network interface 106 converts encoded audio signal 105 to a format such as an internet protocol (IP) packet or other network addressable format, and transmits the audio signal to network 120, which can be a local area network (LAN), a wide area network (WAN), the Internet, or a combination thereof.

The audio signal can be received by one or more network interface devices 108 connected to network 120. Network interface 108 receives the transmitted audio data from network 120 and provides the audio data 109 to decoder 110, which decodes the audio data 109 according to embodiments of the present invention, and provides output audio signal 111 to output audio device 112. Audio device 112 could be an audio sound system having a loudspeaker or other transducer, or audio device could be a digital file that stores a digitized version of output audio signal 111.

In some embodiments, encoder 104, network interfaces 106 and 108 and decoder 110 can be implemented, for example, by a computer such as a personal computer with a wireline and/or wireless network connection. In other embodiments, for example, in broadcast audio situations, encoder 104 and network interface 106 are implemented by a computer coupled to network 120, and network interface 108 and decoder 110 are implemented by portable device such as a cellular phone, a smartphone, a portable network enabled audio device, or a computer. In some embodiments, encoder 104 and/or decoder 110 are included in a CODEC.

In some embodiments, for example, in broadcast audio applications, the encoding algorithms implemented by encoder 104 are more complex than the decoding algorithms implemented by decoder 110. In some applications, encoder 104 encoding audio signal 103 can use non-real time processing techniques and/or post-processing. In such broadcast applications, especially where decoder 110 is implemented on a low-power device, such as a network enabled audio device, embodiment low complexity decoding algorithms allow for real-time decoding using a small amount of processing resources.

Figure 2A:
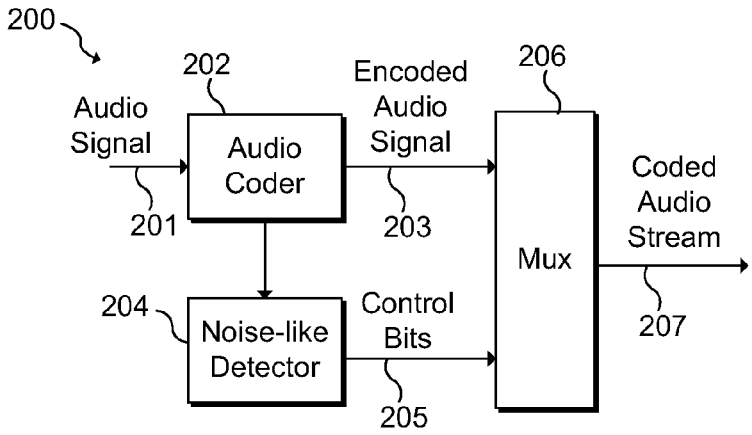
FIGS. 2*a-c* illustrate an embodiment encoder and two embodiment decoders.

FIG. 2*a* illustrates audio encoder 200 according to an embodiment of the present invention. Encoder 200 has audio coder 202 that produces encoded audio signal 203 based on input audio signal 201. Audio coder 202 can operate according to algorithms such as algebraic code excited linear prediction (ACELP), Transform Coding, transform coded excitation (TCX), and other audio coding schemes. Noise-like detector 204 is coupled to audio coder 202 and determines whether input audio signal 201, or portions of input audio signal 201 are noise-like. In an embodiment, a noise-like signal could include white noise, colored noise, or other stationary signals such as background noise, or sustained tones, such as those heard in orchestral performances. Noise-like detector 204 outputs control bits 205 based on its determination. In some embodiment, this determination is a binary, two-state determination, meaning that either the signal is determined to be noise-like or not noise-like. In other embodiments, noise-like detector 204 determines a degree to which the signal is noise-like. Encoded audio signal 203 and control bits 205 are multiplexed by Mux 206 to produce coded audio stream 207. In embodiments, coded audio stream 207 is transmitted to a receiver.

Figure 2B:
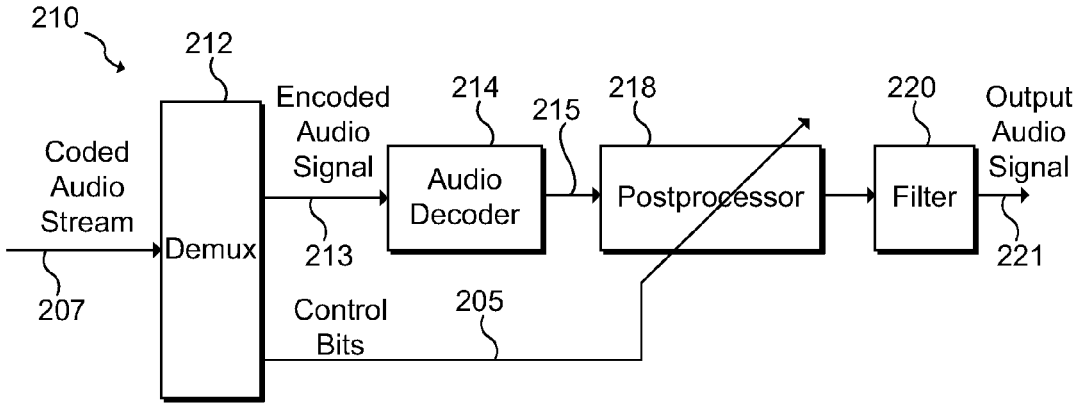

FIG. 2*b* illustrates audio decoder 210 according to an embodiment of the present invention. Coded audio stream 207 is demultiplexed by Demux 212 to produce encoded audio signal 213 and control bits 205. Audio decoder 214 produces decoded audio signal 215, which is then processed by post-processor 218 to compensate for artifacts from the coding/decoding process. Control bits 205 based on the encoder's determination of whether the source audio signal is a noise-like signal is used to adjust the post-processing strength. For example, in an embodiment, the more noise-like the audio signal is, the weaker post-processing strength used. In some embodiment, the output of post-processor 218 is filtered by filter 220 to form output audio signal 221.

Figure 2C:
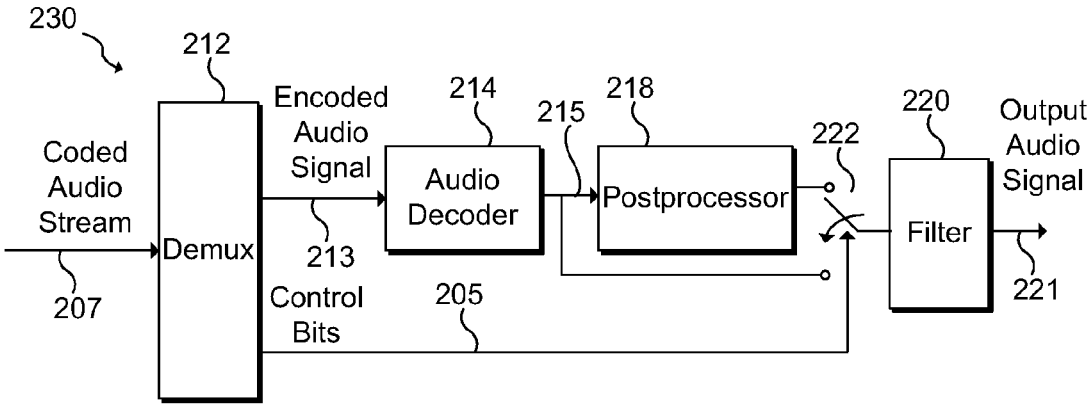

Embodiment decoder 230 illustrated in FIG. 2*c* is similar to FIG. 2*b*, except that post-processor 218 is bypassed and/or disabled when control bits 205 indicate that the signal is noise-like. Switch 222 is illustrated to represent a bypass mechanism, however, in embodiments, post-processor can be bypassed using any technique, such as refraining from executing a software routine, disabling a circuit, multiplying signal 215 by one, and other techniques.

Figure 3A:
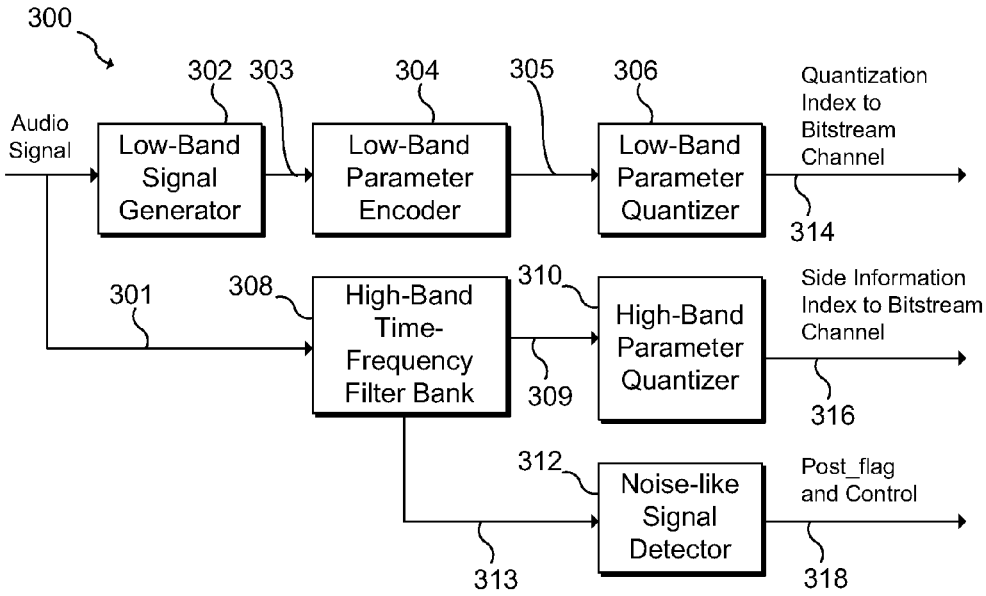
FIGS. 3*a-b* illustrate another embodiment encoder and decoder.
Figure 3B:
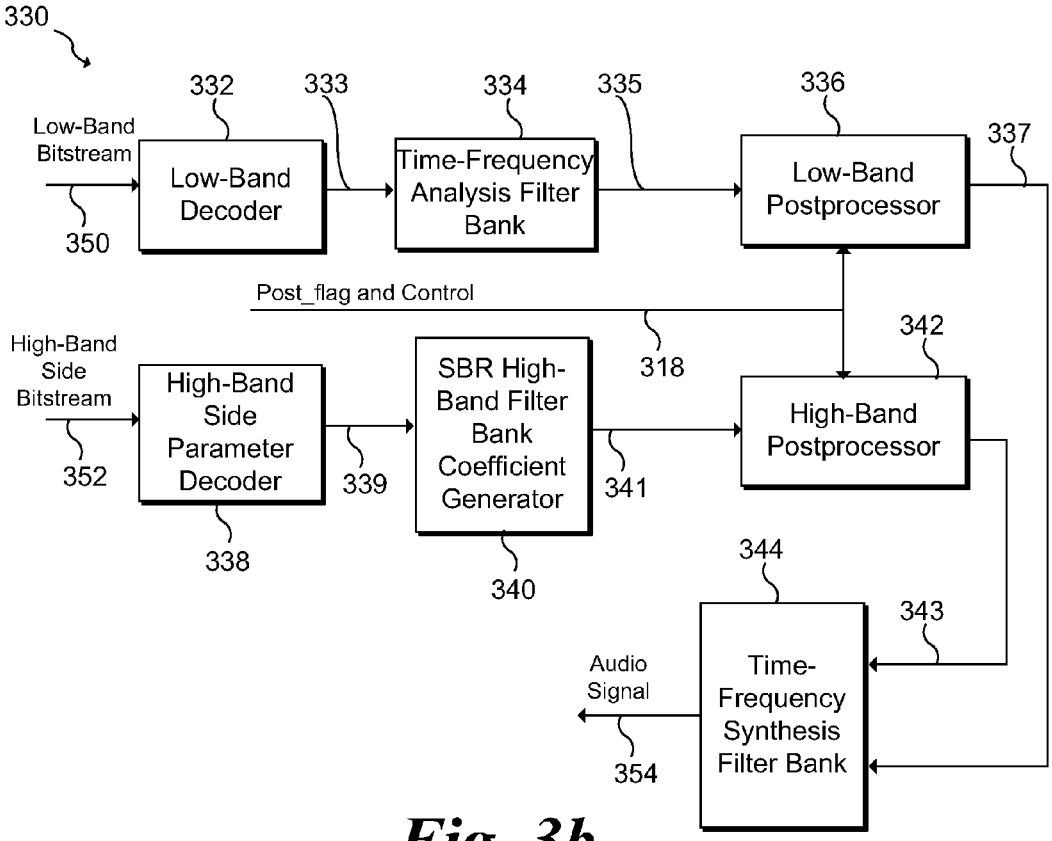

FIGS. 3*a-b* illustrate an embodiment encoder and an embodiment decoder according to another embodiment of the present invention. Encoder 300 in FIG. 3*a* has low-band signal generator 302 that produces low-band parameters 303 from input audio signal 301. In an embodiment, low-band signal generator 302 low-pass filters and decimates input audio signal 301 by a factor of two. For example, for embodiments with a full input audio bandwidth of 16 KHz, the output of the low-band signal generator 302 has a bandwidth of 8 KHz. In alternative embodiments, other bandwidths and/or decimation factors can be used. In further embodiments, decimation can be omitted. Low-band parameter encoder 304 produces low-band parameters 305 from low-band signal 303. In an embodiment, low-band parameter encoder 304 is implemented by a coder such as an ACELP coder, transform coder, or a TCX coder. Alternatively, other structures such as a sinusoidal audio coder or a relaxed code excited linear prediction (RCELP) can be used. In some embodiments, for instance, for a transform coder, low band parameters 305, which correspond to spectral coefficients, are quantized by quantizer 306 to produce quantization index to bitstream channel 314.

High-band time-frequency filter bank 308 produces high-band side parameters 309 and 313 from input audio signal 301. In an embodiment, high-band time-frequency filter bank 308 is implemented as a quadrature modulated filter bank (QMF), however, other structures such as fast Fourier transform (FFT), modified discrete cosine transform (MDCT) or modified complex lapped transform (MCLT) can be used. In some embodiments, high-band side parameters 309 are quantized by quantizer 310 to produce side information index to bitstream channel 316. Noise-like signal detector 312 produces post_flag and control parameters 318 from high-band side parameters 313.

In a first embodiment option, a one-bit post_flag is transmitted to the decoder at each frame. Here, post_flag can assume one of two states. A first state represents a normal signal and indicates to the decoder that normal post-processing is used. A second state represents a noise-like signal, and indicates to the decoder that the post-processing is deactivated. Alternatively, weaker post-processing can be used in the second state.

In a second embodiment option, one-bit post_flag is used to signal a change in the signal characteristic. When a change of characteristic is detected and post-flag is set to a first state, otherwise for a normal case, post_flag is set to a second state. When post_flag is in the first state, the post processing control parameters are transmitted to the decoder to adapt the post-processing behavior. Additional parameters control the strength of the post-processing along the time and/or frequency direction. In that case, different control parameters can be transmitted for the lower and higher frequency bands.

In an embodiment noise-like signal detector 312 determines whether the high-band parameters 313 indicate a noise-like signal by first estimating the time-frequency (T/F) energy for each T/F tile. In an embodiment that have a long frame of 2048 output samples, T/F energy array is estimated from the Analysis Filter Bank Coefficients according to:

$$\text{TF_energy}[i][k]=(Sr[i][k])^2+(Si[i][k])^2, i=0,1,2,\ldots,31; k=0,1,\ldots,K-1,$$

where K is the maximum sub-band index that can depend on the input sampling rate and bit rate; is the time index that represents a 2.5 ms step for a 12 kbps CODEC with a 25,600 Hz sampling frequency and a 3.333 ms step for a 8 kbps CODEC with a 19,200 Hz sampling frequency; k is a frequency index indicating a 200 Hz step for a 12 kbps CODEC with a 25,600 Hz sampling frequency and a 150 Hz step for a 8 kbps CODEC with a 19,200 Hz sampling frequency; Sr[ ][ ] and Si[ ] [ ] are the analysis Filter Bank complex coefficients that are available at encoder, and TF_energy[i] [k] represents energy distribution for low band in both time and frequency dimensions. In alternative embodiments, other sampling rates and frame sizes can be used.

In a second step, a time direction variance of the energy in each frequency subband is estimated:

$$Var_\text{band_energy}[k]=\text{Variance}\{\text{TF_energy}[i][k], \text{ for all } i \text{ of specific range}\}.$$

The previous time direction variance can be computed based on the following equation:

$$VarBand_{Energy}[k] = \frac{1}{N-1}\sum_{i=0}^{N}\left(TF_{energy}[i][k] - mean_{TF_{energy}}[k]\right)^2$$

with N being the number of time slots and $$mean_{TF_{energy}}[k] = \frac{1}{N}\sum_{i=0}^{N} TF_{energy}[i][k]$$

In an embodiment, Var_band_energy[k] is optionally smoothed from previous time index to current time index by excluding energy dramatic change (not smoothed at dramatic energy change point). In a third step, a frequency direction variance of the time direction variance for each frame, which can be seen as a global variance of the frame, is then estimated:

$$Var_\text{block_energy}=\text{Variance}\{Var_\text{band_energy}[k], \text{ for all } k \text{ of specific range}\}.$$

The frequency direction variance of the time direction variance can be computed based on the following equation:

$$VarBlock_{Energy} = \frac{1}{K-1}\sum_{k=0}^{K}\left(VarBand_{Energy}[k] - mean_{VarBand_{Energy}}\right)^2$$

with $$mean_{VarBand_{Energy}} = \frac{1}{K}\sum_{k=0}^{K} VarBand_{Energy}[k].$$

In some embodiments, a smoothed time/frequency variance Var_block_smoothed_energy from previous time block to current time block is optionally estimated:

$$Var_block_smoothed_energy = Var_block_smoothed_energy * c + Var_block_energy * (1-c),$$

where c is a constant parameter usually set to the value c1 between 0.8 and 0.99. Alternatively, c can be set outside of this range. For the first block of audio signal, or for the first frame of the input audio signal, Var_block_smoothed_energy is initialized with an initial Var_block_energy value.

In an embodiment, the smoothing constant is adapted to the level of the total variance Var_block_smoothed_energy. In some embodiments, hysteresis is used to make the total variance more stable. Two thresholds THR1 and THR2, which are used to avoid too quick changes in the Var_block_smoothed_energy, are implemented as follows:

if $Var_block_smoothed_energy < THR1$, then $c = c2$, with $c2$ between 0.99 and 0.999;

if $c == c1$ and $Var_block_smoothed_energy > THR2$, then $c = c1$.

Next, Var_block_smoothed_energy is used to detect the noise like signal comparing the time/frequency variance to a threshold THR3. When the Var_block_smoothed_energy is lower than THR3, the signal is considered as noise-like signal and the following two options can be used to control the post-processing that should be done at the decoder side. In alternative embodiments, other threshold schemes can be used, for example, several thresholds THR4, THR5, etc., can be used to quantify a similarity with a noise-like signal, where each interval between two of these thresholds correspond to a certain set of transmitted control data.

In an embodiment, decoder 330 in FIG. 3*b* has low-band decoder 332 that produces decoded low band signal 333 from low-band bitstream 350, and high-band side parameter decoder 338 that produces high band side parameters 339 from high-band side bitstream 352. Time-frequency analysis filter bank 334 produces low-band filter bank coefficients 335, which is a frequency domain representation of low-frequency content of the output audio signal. In an embodiment, time-frequency analysis filter bank 334 is implemented by a QMF. SBR high-band filter bank coefficient generator 340 produces high-band filter bank coefficients 341, which are a frequency domain representation of the high frequency content of the output audio signal. In an embodiment, SBR high-band filter bank coefficient generator 340 is also implemented in the QMF domain by the replication of low-band filter bank coefficients 335, and an adjustment of high frequency envelope 339 received as a side parameter to form the high-band filter bank coefficients. Alternatively, SBR high-band filter bank coefficient generator 340 can also be implemented by other structures such as a noise and/or sinusoid generator in the QMF domain.

In an embodiment, low-band post-processor 336 applies post-processing to low-band filter bank coefficients 335 to produce post-processed low-band filter bank coefficients 337, and high-band post-processor 342 applies post-processing to high-band filter bank coefficients 341 to produce post-processed high-band filter bank coefficients 343. In an embodiment, the strength of the post-processing is controlled by post-flag and control data 318. Output audio signal 354 is then constructed based on high and low band post-processed filter bank coefficients 343 and 337 using time-frequency synthesis filter bank 344. In some embodiments, time-frequency synthesis filter bank 344 is implemented using a synthesis QMF.

In an embodiment, the same algorithm is used for low-band post-processor 336 and high-band post-processor 342, but different parameter controls are used. Weak post-processing is applied to the low band that corresponds to a core decoder and stronger post-processing to the high band because the signal generated by the spectral bandwidth resolution (SBR) tool can comprise some noise. In an embodiment, the energy distributions are approximated in the complex QMF domain for each super-frame for both time and frequency direction at the encoder side. The time direction energy distribution is estimated by averaging frequency direction energies:

$$T_energy[i] = Average\{TF_energy[i][k], \text{ for all } k \text{ of specific range}\},$$

where i is a time slot index and k is a subband frequency index. The frequency direction energy distribution is estimated by averaging time direction energies:

$$F_energy[k] = Average\{TF_energy[i][k], \text{ for all } i \text{ of specific range}\}$$

Then, the time direction energy modification gains are calculated:

$$Gain_t[i] = (T_energy[i])^{t_control},$$

where t_control is control parameter. Similarly, the frequency direction energy modification gains are calculated using the following equation:

$$Gain_f[k] = (F_energy[k])^{f_control},$$

where f_control is control parameter. The final energy modification gain for each T/F point in the QMF time/frequency plan is then computed as:

$$Gain_tf[i][k] = Gain_t[i] \cdot Gain_f[k].$$

In some embodiments, the gain to be applied in the above post-processing is highly dependent on the signal type. For some signals with slow variation of the energy in the time/frequency plane in both time and frequency direction, a smoother post-processing or even no post-processing is applied in some embodiments. Therefore, the signal type is first detected at the encoder and post processing control parameter is transmitted as side information. In some embodiments, the encoder calculates the gains and passes the gains to the decoder. In further embodiments, encoder passes t_control and f_control to the decoder and the decoder calculates the gains.

In the embodiments described in FIGS. 3*a* and 3*b*, algorithms are based on a Filter Bank Analysis and Time/Frequency post-processing tool. It should be appreciated, however, that in alternative embodiments, a different detection algorithm may be designed for different CODECs and different post-processing methods may be used, for example harmonic signal detection can be performed at the encoder to detect whether the input signal is highly harmonic or tonal and have been correctly coded by the low band encoder. The controlled post-processing or post-filtering performed at the decoder side can be a harmonic post processing for pitch enhancement to remove unwanted noise between the harmonics of the audio signal. Such a post-filter is described by Juin-Hwey Chen; Gersho, A.; "Adaptive postfiltering for quality enhancement of coded speech". IEEE Transactions on Speech and Audio Processing. Volume: 3 Issue: 1 Publication Date: January 1995, Page(s):59-71. Digital Object Identifier:

10.1109/89.365380 or to ISO/IEC JTC1/SC29/WG11 N11213 "WD6 of USAC," which is incorporated herein by reference.

FIGS. 4*a*-4*e* illustrate block diagrams of an embodiment encoder 400 and decoder 450 using an adaptive Time/Frequency domain post-processing scheme. In one embodiment, encoder 400 and decoder 450 are implemented using a MPEG-4 coding scheme. In some embodiments, encoder 400 and decoder 450 are used in an ISO MPEG-D Unified Speech and Audio Coding (USAC) application.

Figure 4A:
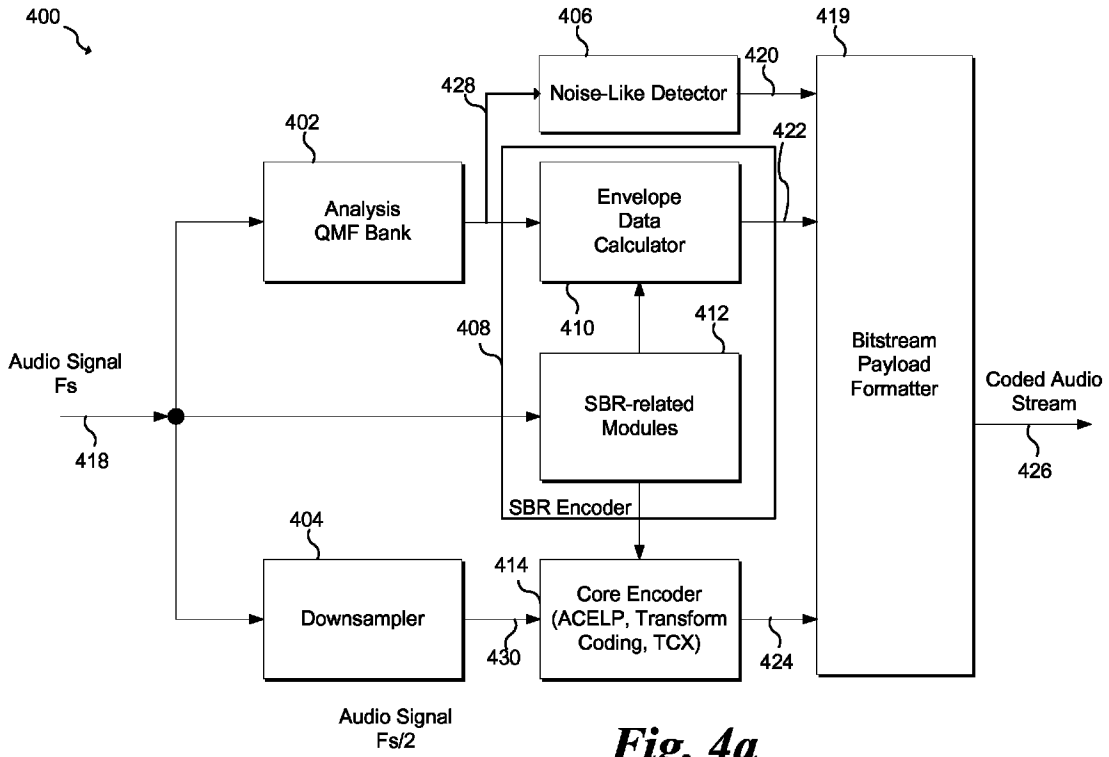
FIGS. 4*a-e* illustrate a further embodiment encoder and decoder.

FIG. 4*a* illustrates an embodiment encoder. Analysis QMF bank 402 creates coefficients 428 from input audio signal 418 for use by SBR encoder 408 and noise-like detector 406. Downsampler 404 decimates audio signal 418 from a sampling rate of Fs to a sampling rate of Fs/2 to form decimated audio signal 430. Core encoder 414 produces an encoded version 424 of the low-band audio signal using one of a variety of encoding schemes including ACELP, transform coding, and TCX coding. Alternatively, greater or fewer coding schemes can be used. In some embodiments, the choice of coding scheme is dynamically selected according to the characteristics of input audio signal 418. Noise detector 406 determines whether audio signal 418 is noise-like according to methods described above, and provides detection flag and post-post-processing control parameters 420.

SBR encoder 408 has envelope data calculator 410 that computes spectral envelope 422 of the high band portion of the encoded audio signal. SBR-related modules 412 partition bandwidth between the high-band portion and the low-band portion of the audio spectrum, directs core encoder 414 with respect to which frequency range to encode, and directs envelope data calculator 410 with respect to which portions of the audio frequency range to calculate the spectral envelope. Bitstream payload formatter 419 multiplexes and formats detection flag and post-processing control parameters 420, high-band spectral envelope 422, and low band encoded data 424 to form coded audio stream 426.

Figure 4B:
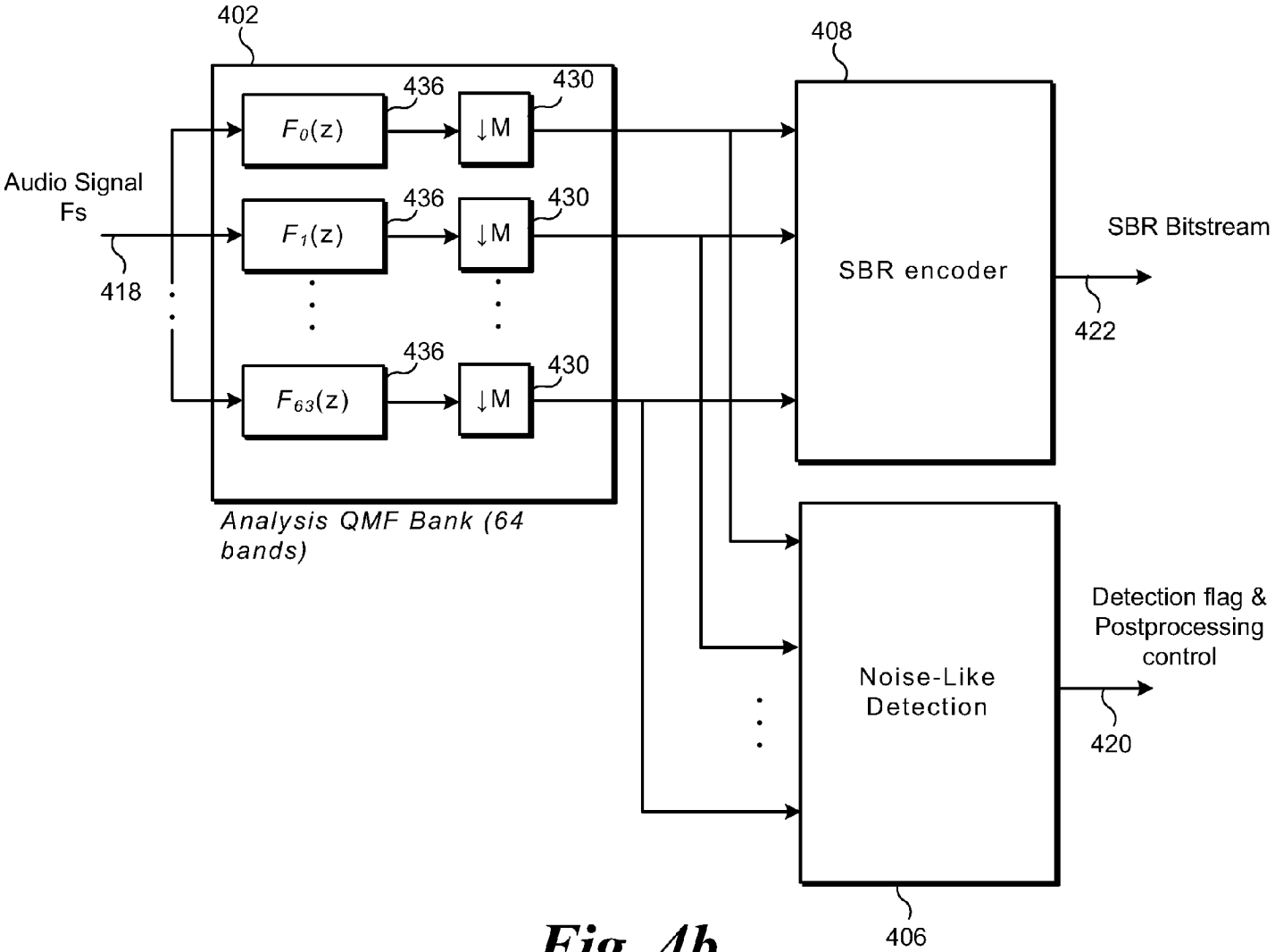

FIG. 4*b* illustrates a block diagram of analysis QMF bank 402 and its interconnections to SBR encoder 408 and noise-like detector. Analysis QMF has a plurality of channels having a digital filter 436 and a decimator 430. In one embodiment, analysis Filter Bank 402 has 64 channels. Alternatively, greater or fewer channels can be used. Outputs of each channel are routed to SBR encoder 408 and noise-like detector 406.

Figure 4C:
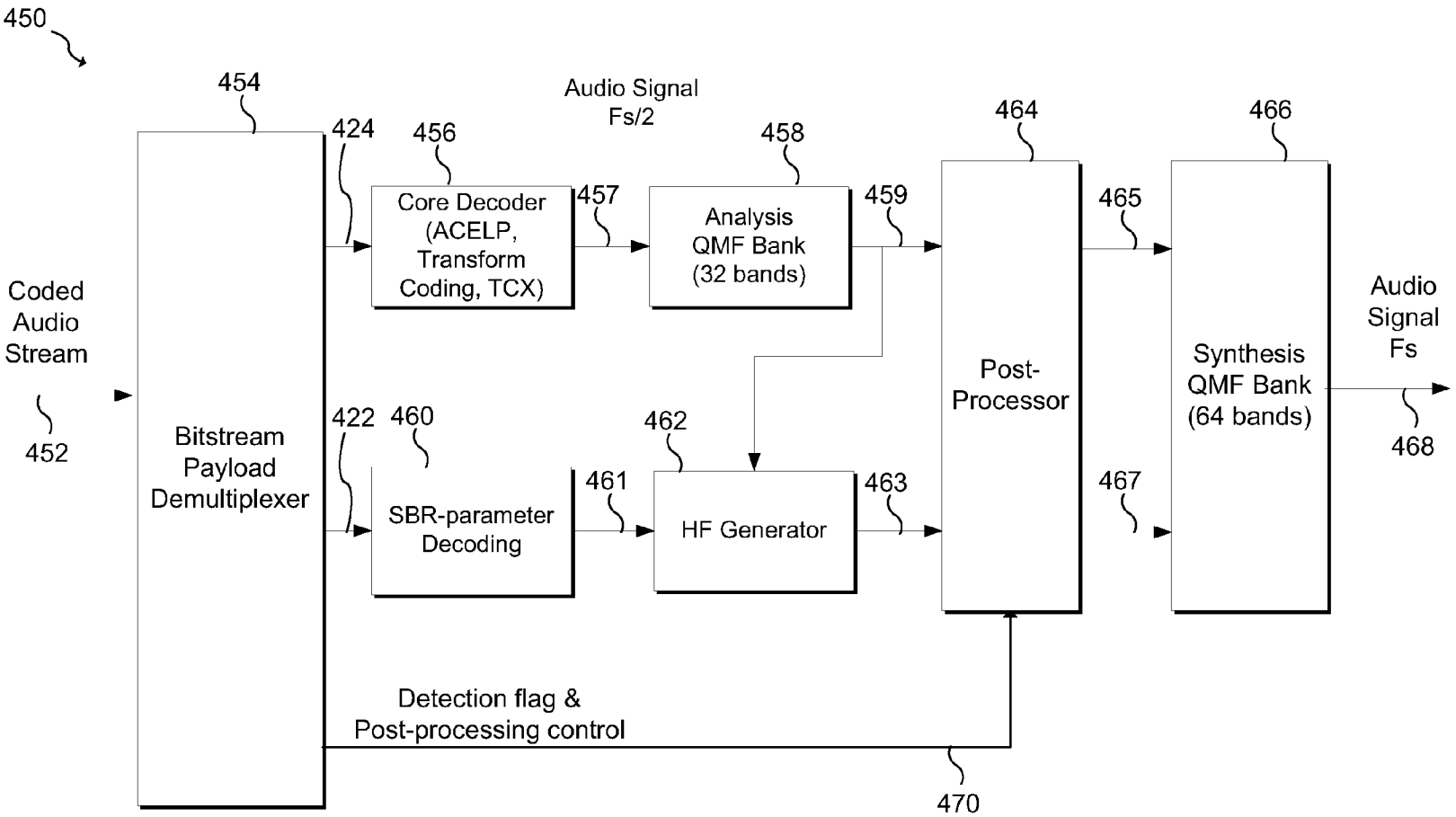

FIG. 4*c* illustrates an embodiment decoder. Bitstream payload demultiplexer 454 demultiplexes coded audio stream 452 into low-band parameters 424, high-band parameters 422 (spectral envelope) and detection flag and post-processing control information 470. Low-band parameters 424 are converted into time domain signal 457 by core decoder 456. In an embodiment, core decoder 456 switches between decoding functions for various coding algorithms such as ACELP, transform coding and TCX based on how coded audio stream 452 was encoded. In further embodiments, other decoding algorithms can be used. In one embodiment, low-band time domain signal 457 is updated at Fs/2. Alternatively, other update rates can be used. Analysis QMF 458 band creates low-band coefficients 459. In one embodiment, analysis QMF 458 has 32 channels, which are half the number of channels in the analysis QMF bank 402 in the encoder of FIG. 4*a*. In alternative embodiments, other numbers of channels can be used.

Spectral envelope parameters 422 are decoded by SBR parameter decoder 460 to produce high-band side parameters 461 for use by HF Generator 462. HF Generator 462 calculates high-band parameters 463 based on high-band side-parameters 461 and based on low-band parameters 459 from analysis QMF 458. Post-processor 464 compensates low-band parameters 459 and high-band parameters 463 for bandwidth extension artifacts created during the coding and decoding process. The amount of post-processing applied to low-band and high-band parameters 459 and 463 is determined based on detection flag and post-processing control information 470. For example, in one embodiment, if detection flag and post-processing control information 470 indicates that the audio signal is noise-like, the post-processor is disabled and/or internally bypassed, and post-processing block 464 passes parameters 465 and 467 to synthesis QMF bank 466, which generates audio signal 468. Alternatively, post-processor 464 adjusts the strength of the post processing according to detection flag and post-processing control information 470. For example, the more noise-like the signal is, the weaker the post-processing post-processor applies to parameters 459 and 463. In an embodiment, synthesis QMF band 466 has 64 bands. Alternatively, a greater or lower number of bands can be used.

Figure 4D:
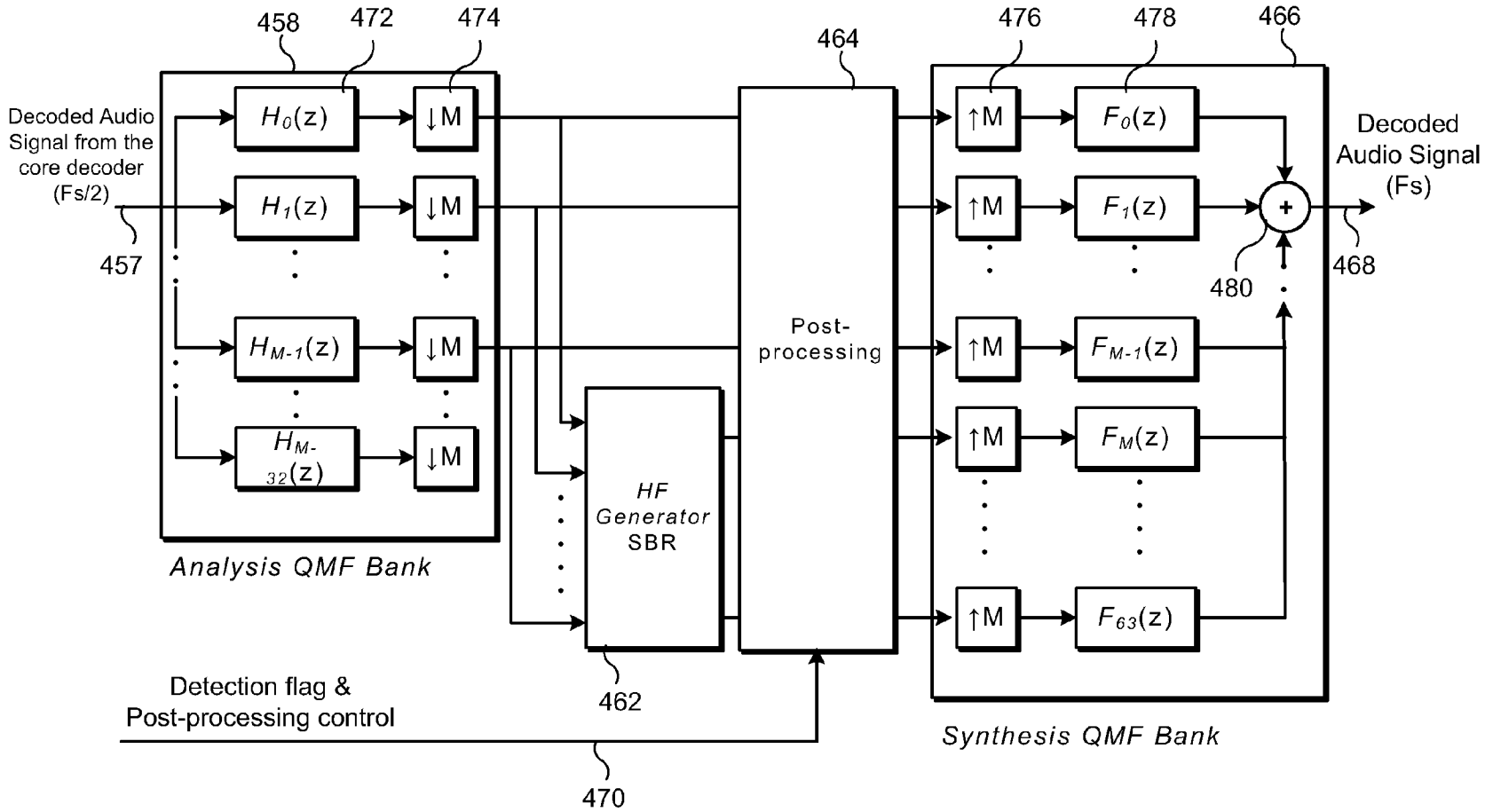

FIG. 4*d* illustrates a more detailed diagram of analysis QMF band 458, synthesis QMF band 466, and their connections to HF generator 462. Each of the 32 channels in analysis QMF bank 458 has a digital filter 472, and a decimator 474, that decimates the audio signal by a factor of M (32 in this case), where M corresponds to the decoded bandwidth from the core decoder. Each output channel is coupled to HF generator 462, and the low band parameters of QMF analysis bank 458 are coupled to post processor 464. Synthesis QMF bank has 64 channels, where each channel has upsampler 476 and digital filter 478. The output of all channels of synthesis QMF bank 466 are summed by summer 480 to produce decoded audio signal 468.

Figure 4E:
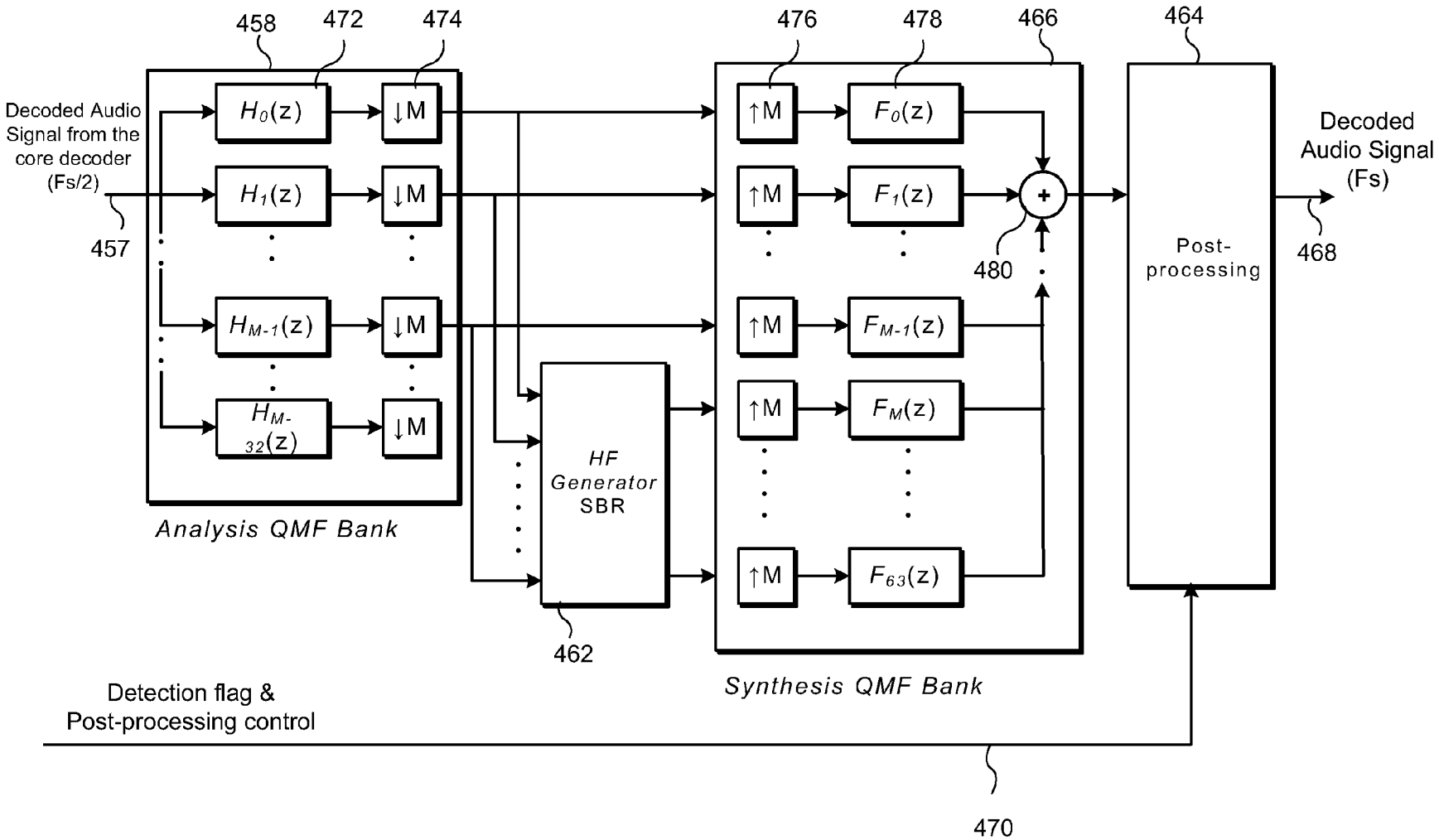

The embodiment of FIG. 4*e* is similar to the embodiment of FIG. 4*d*, except that the post-processing 464 is applied on the time domain signal obtained from synthesis filter bank 466. In an embodiment, post-processing 464 can be a filtering operation or a simple gain which is applied on the time domain signal, where the filtering operation is controlled by the received flag 470. It should be noted that this time domain post processing could also be applied to the time domain of the decoded audio signal from the core decoder prior to analysis filter bank 458.

Figure 5:
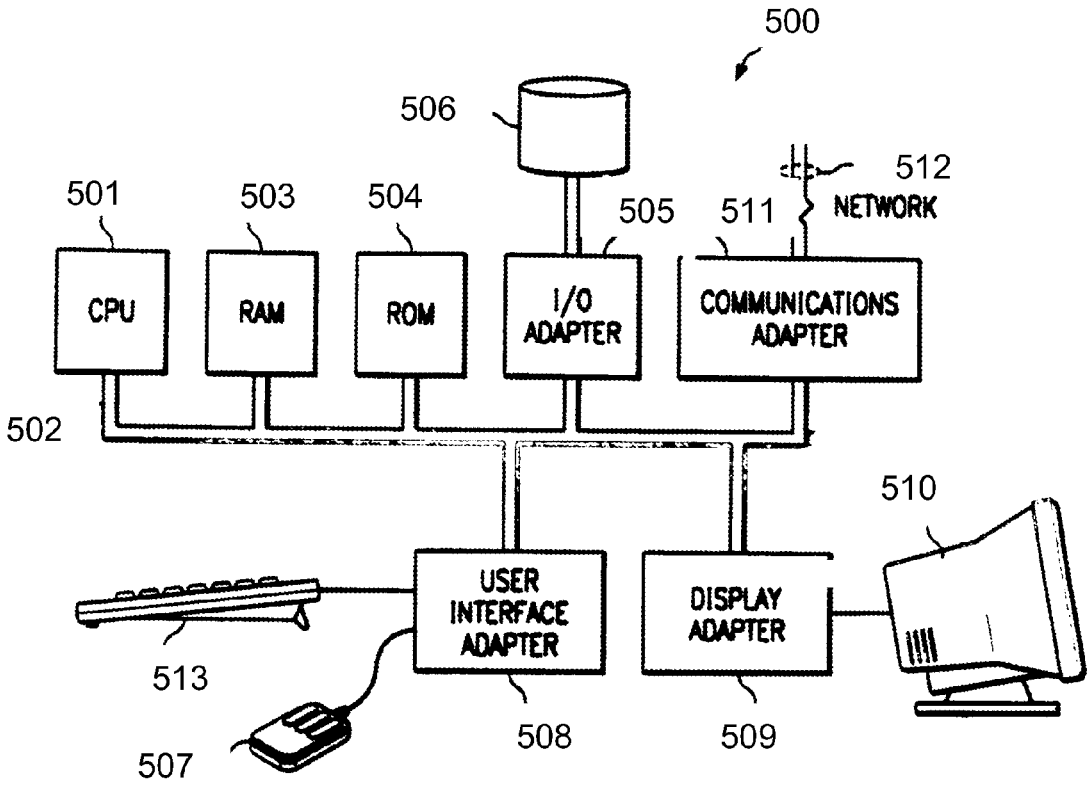
FIG. 5 illustrates an embodiment computer system for implementing embodiment algorithms.

FIG. 5 illustrates computer system 500 adapted to use embodiments of the present invention, e.g., storing and/or executing software associated with the embodiments. Central processing unit (CPU) 501 is coupled to system bus 502. CPU 501 may be any general purpose CPU. However, embodiments of the present invention are not restricted by the architecture of CPU 501 as long as CPU 501 supports the inventive operations as described herein. Bus 502 is coupled to random access memory (RAM) 503, which may be SRAM, DRAM, or SDRAM. ROM 504 is also coupled to bus 502, which may be PROM, EPROM, or EEPROM. RAM 503 and ROM 504 hold user and system data and programs as is well known in the art.

Bus 502 is also coupled to input/output (I/O) adapter 505, communications adapter 511, user interface 508, and display adaptor 509. The I/O adapter 505 connects storage devices 506, such as one or more of a hard drive, a CD drive, a floppy disk drive, a tape drive, to computer system 500. The I/O adapter 505 is also connected to a printer (not shown), which would allow the system to print paper copies of information such as documents, photographs, articles, and the like. Note that the printer may be a printer, e.g., dot matrix, laser, and the like, a fax machine, scanner, or a copier machine. User interface adaptor is coupled to keyboard 513 and mouse 507, as well as other devices. Display adapter, which can be a display card in some embodiments, is connected to display device 510. Display device 510 can be a CRT, flat panel display, or other type of display device. Communications adapter 511 is configured to couple system 500 to network 512. In one embodiment communications adapter 511 is a network interface controller (NIC).

Figure 6:
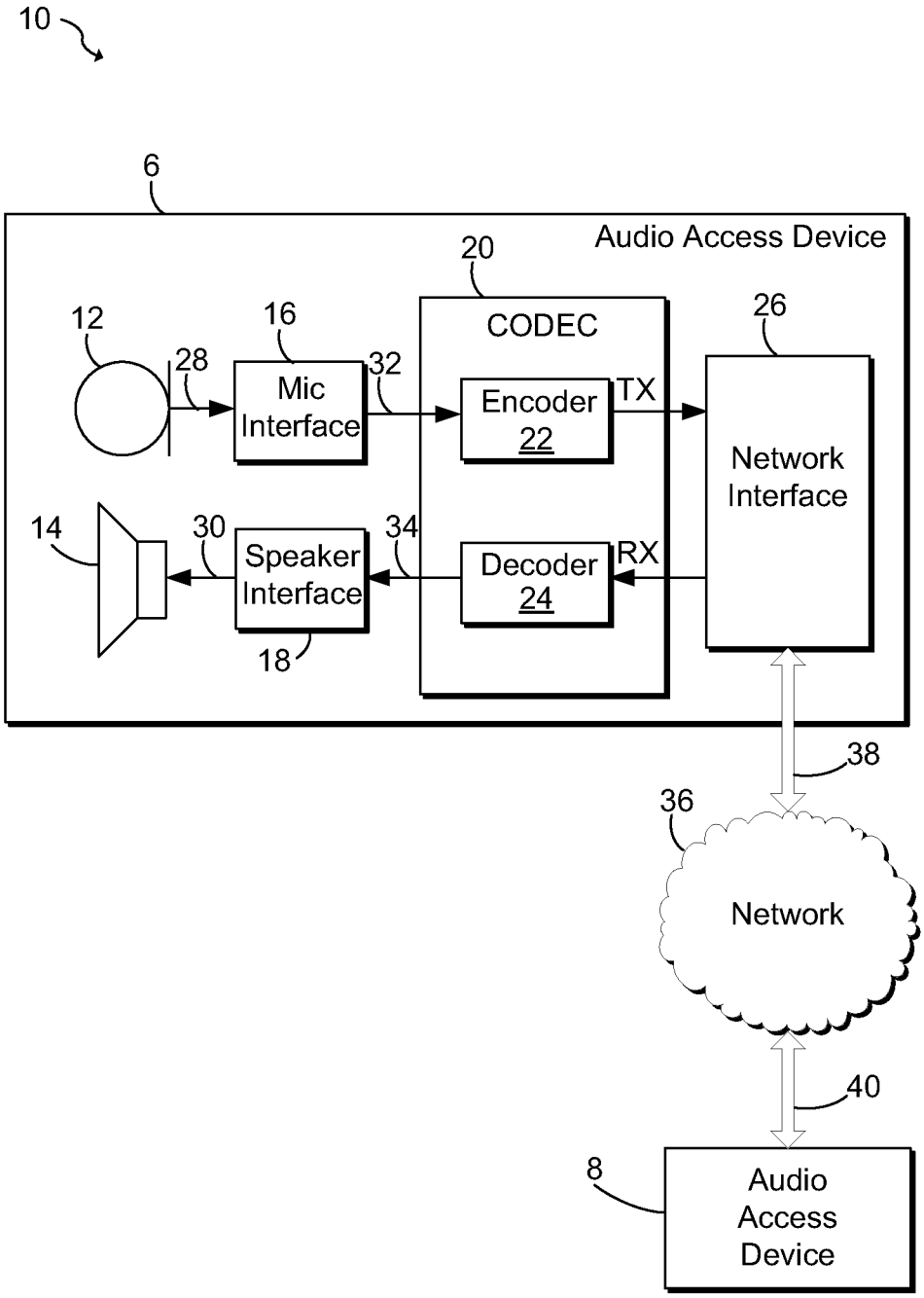
FIG. 6 illustrates a communication system according to an embodiment of the present invention.

FIG. 6 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PSTN) and/or the internet. In another embodiment, audio access device 6 is a receiving audio device and audio access device 8 is a transmitting audio device that transmits broadcast quality, high fidelity audio data, streaming audio data, and/or audio that accompanies video programming. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 36, and converts encoded audio signal RX into digital audio signal 34. Speaker interface 18 converts digital audio signal 34 into audio signal 30 suitable for driving loudspeaker 14.

In embodiments of the present invention, where audio access device 6 is a VoIP device, some or all of the components within audio access device 6 can be implemented within a handset. In some embodiments, however, microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PSTN.

Advantages of some embodiments include an ability to implement post-processing at the decoder side without encountering audio artifacts for noise-like signals.

Advantages of embodiments include improvement of subjective received sound quality at low bit rates with low cost.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of receiving an encoded audio signal, the method comprising:

receiving an encoded audio signal comprising a coded representation of an input audio signal and a control code based on an audio signal class;

decoding the audio signal comprising producing high-band coefficients and low-band coefficients from the audio signal, wherein the high-band coefficients comprises a time-frequency domain representation of high frequency content of the audio signal and the low-band coefficients comprises a time-frequency domain representation of low frequency content of the audio signal;

post-processing the decoded audio signal in a first mode using a hardware-based audio decoder if the control code indicates that the audio signal class is not of a first audio class, wherein post-processing the decoded audio signal in the first mode comprises modifying low-band coefficients and high-band coefficients in the time-frequency domain to correct for audio coding artifacts to produce modified low-band coefficients and modified high-band coefficients;

post-processing the decoded audio signal in a second mode using the hardware-based audio decoder if the control code indicates that the audio signal class is of the first audio class; and producing an output audio signal based on the post-processed decoded audio signal.

2. The method of claim 1, wherein:

the post-processing in the first mode is stronger than the post-processing in the second mode;

the coded representation of the input audio signal comprises a low-band bitstream and a high-band bitstream;

decoding the audio signal comprises decoding the low-band bitstream to produce a low-band signal, and decoding the high-band bitstream to produce high-band side parameters;

the producing the low-band coefficients comprises performing a time-frequency filter bank analysis of the low-band signal;

the producing the high-band coefficients comprises generating the high-band coefficients based on the high-band side parameters and based on the producing low-band coefficients; and the producing the audio signal comprises performing a time-frequency filter bank synthesis of the modified low-band coefficients and the modified high-band coefficients.

3. The method of claim 2, wherein the audio class comprises one of at least three audio classes, and wherein post-processing further comprises adjusting a strength of the modifying according to the audio class.

4. The method of claim 1, wherein the post-processing in the first mode is stronger than the post-processing in the second mode.

5. The method of claim 4, wherein:

the post-processing in the first mode comprises compensating for audio bandwidth extension artifacts; and the post-processing in the second mode comprises not compensating for audio bandwidth extension artifacts.

6. The method of claim 1, further comprising determining the audio signal class, wherein determining the audio signal class comprises:

monitoring a flag in the control code;

determining that the audio signal class is of the first audio class when the flag is in a first state; and determining that the audio signal class is not of the first audio class when the flag is in a second state.

7. The method of claim 1, further comprising determining the audio signal class, wherein determining the audio signal class comprises:

monitoring a post flag in the control code;

when the post flag is in a first state, reading an audio signal class field in the control code to determine the audio signal class; and when the post flag is in a second state, the audio signal class is the same as an immediately previous audio signal class.

8. The method of claim 7, wherein the post flag is a one-bit post flag.

9. The method of claim 1, wherein the first audio class comprises a noise-like audio class.

10. The method of claim 1, wherein the first audio class comprises a harmonic-like audio class.

11. The method of claim 1, wherein using the hardware-based audio decoder comprises using a processor.

12. The method of claim 1, wherein using the hardware-based audio decoder comprises using dedicated hardware.

13. The method of claim 1, wherein the control code indicates that the audio signal class is of the first audio class when an encoded audio signal has a time/frequency variance that is within a predetermined range.

14. The method of claim 13, wherein:

the first audio class is a noise-like audio class; and the predetermined range is less than a predetermined threshold.

15. The method of claim 13, wherein the time/frequency variance comprises a smoothed time-frequency variance.

16. A system for receiving an encoded audio signal, the system comprising:

a decoder configured to receive an encoded audio signal comprising a coded representation of an input audio signal and a control code based on an audio signal class, and decode the audio signal by producing high-band coefficients and low-band coefficients from the audio signal, wherein the high-band coefficients comprises a time-frequency domain representation of high frequency content of the audio signal and the low-band coefficients comprises a time-frequency domain representation of low frequency content of the audio signal; and a hardware-based post-processor configured to post-process the decoded audio signal in a first mode if the control code indicates that the audio signal class is not of a first audio class, post-process the decoded audio signal in a second mode if the control code indicates that the audio signal class is of the first audio class, produce an output audio signal based on the post-processed decoded audio signal, and modify low-band coefficients and high-band coefficients in the time-frequency domain to correct for audio coding artifacts to produce modified low-band coefficients and modified high-band coefficients.

17. The system of claim 16, wherein:

the coded representation of the input audio signal comprises a low-band bitstream and a high-band bitstream; and the decoder is further configured to:

decode the low-band bitstream to produce a low-band signal, produce the low-band coefficients by performing a time-frequency filter bank analysis of the low-band signal, decode the high-band bitstream to produce high-band side parameters, and generate the high-band coefficients based on the high-band side parameters and based on the producing the low-band coefficients; and the hardware-based post-processor is further configured to produce the audio signal by performing a time-frequency filter bank synthesis of the modified low-band coefficients and modified high-band coefficients, wherein the post-processing in the first mode is stronger than the post-processing in the second mode.

18. The system of claim 17, wherein the audio class comprises one of at least three audio classes, and wherein the post-processor is further configured to adjust a strength of the modifying according to the audio class.

19. The system of claim 16, wherein the post-processing implemented by the hardware-based post-processor in the first mode is stronger than the post-processing in the second mode.

20. The system of claim 19, wherein:

the post-processing implemented by the hardware-based post-processor in the first mode comprises compensating for audio bandwidth extension artifacts; and the post-processing implemented by the hardware-based post-processor in the second mode comprises not compensating for audio bandwidth extension artifacts.

21. The system of claim 20, wherein the hardware-based post-processor is further configured to determine the audio signal class by:

monitoring a flag in the control code;

determining that the audio signal class is of the first audio class when the flag is in a first state; and determining that the audio signal class is not of the first audio class when the flag is in a second state.

22. The system of claim 16, wherein the hardware-based post-processor is further configured to determine the audio signal class by performing the following steps:

monitoring a post flag in the control code;

when the post flag is in a first state, reading an audio signal class field in the control code to determine the audio signal class; and when the post flag is in a second state, setting the audio signal class to be a same audio signal class the same as an immediately previous audio signal class.

23. The system of claim 22, wherein the post flag is a one-bit post flag.

24. The system of claim 16, wherein the first audio class comprises a noise-like audio class.

25. The system of claim 16, wherein the first audio class comprises a harmonic-like audio class.

26. The system of claim 16, wherein the hardware-based post-processor comprises a processor.

27. The system of claim 16, wherein the hardware-based post-processor comprises dedicated hardware.

28. The system of claim 16, wherein the control code indicates that the audio signal class is of the first audio class when an encoded audio signal has a time/frequency variance that is within a predetermined range.

29. A non-transitory computer readable medium with an executable program stored thereon, wherein the program instructs a microprocessor to perform the following steps:

receiving an encoded audio signal comprising a coded representation of an input audio signal and a control code based on an audio signal class;

decoding the audio signal comprising producing high-band coefficients and low-band coefficients from the audio signal, wherein the high-band coefficients comprises a time-frequency domain representation of high frequency content of the audio signal and the low-band coefficients comprises a time-frequency domain representation of low frequency content of the audio signal;

post-processing the decoded audio signal in a first mode if the control code indicates that the audio signal class is not of a first audio class, wherein post-processing the decoded audio signal in the first mode comprises modifying low-band coefficients and high-band coefficients in the time-frequency domain to correct for audio coding artifacts to produce modified low-band coefficients and modified high-band coefficients;

post-processing the decoded audio signal in a second mode if the control code indicates that the audio signal class is of the first audio class; and producing an output audio signal based on the post-processed decoded audio signal.

30. The non-transitory computer readable medium of claim 29, wherein the coded representation of the input audio signal comprises a low-band bitstream and a high-band bitstream;

the steps decoding the audio signal comprises decoding the low-band bitstream to produce a low-band signal, producing the low-band coefficients by performing a time-frequency filter bank analysis of the low-band signal, decoding the high-band bitstream to produce high-band side parameters, generating the high-band coefficients based on the high-band side parameters and based on the producing the low-band coefficients; and the step of producing the audio signal comprises performing a time-frequency filter bank synthesis of the modified low-band coefficients and modified high-band coefficients, wherein the post-processing in the first mode is stronger than the post-processing in the second mode.

31. The non-transitory computer readable medium of claim 30, wherein the audio class comprises one of at least three audio classes, and wherein the post-processing further comprises adjusting a strength of the modifying according to the audio class.

32. The non-transitory computer readable medium of claim 29, wherein the post-processing in the first mode is stronger than the post-processing in the second mode.

33. The non-transitory computer readable medium of claim 32, wherein:

the post-processing in the first mode comprises compensating for audio bandwidth extension artifacts; and the post-processing in the second mode comprises not compensating for audio bandwidth extension artifacts.

34. The non-transitory computer readable medium of claim 33, wherein the step of determining the audio signal class comprises:

monitoring a flag in the control code;

determining that the audio signal class is of the first audio class when the flag is in a first state; and determining that the audio signal class is not of the first audio class when the flag is in a second state.

35. The non-transitory computer readable medium of claim 29, the program further instructs the microprocessor further to perform the step of determining the audio signal class, wherein, the step of determining the audio signal class comprises:

monitoring a post flag in the control code;

determining that the audio signal class is of the first audio class when the post flag is in a first state; and determining that the audio signal class is not of the first audio class when the post flag is in a second state.

36. The non-transitory computer readable medium of claim 35, wherein the post flag is a one-bit post flag.

37. The non-transitory computer readable medium of claim 29, the program further instructs the microprocessor further to perform the step of determining the audio signal class, wherein, the step of determining the audio signal class comprises:

monitoring a post flag in the control code;

when the post flag is in a first state, reading an audio signal class field in the control code to determine the audio signal class; and when the post flag is in a second state, the audio signal class is the same as an immediately previous audio signal class.

38. The non-transitory computer readable medium of claim 29, wherein the first audio class comprises a noise-like audio class.

39. The non-transitory computer readable medium of claim 29, the first audio class comprises a harmonic-like audio class.

40. The non-transitory computer readable medium of claim 29, wherein the control code indicates that the audio signal class is of the first audio class when an encoded audio signal has a time/frequency variance that is within a predetermined range.

* * * * *